United States Patent [19]

Ward

[11] 3,934,566

[45] Jan. 27, 1976

[54] COMBUSTION IN AN INTERNAL COMBUSTION ENGINE

[76] Inventor: Michael A. V. Ward, 205 Walden St., Apt. 5-D, Cambridge, Mass. 02140

[22] Filed: Aug. 12, 1974

[21] Appl. No.: 496,393

[52] U.S. Cl. .. 123/119 E; 123/148 E; 219/10.55 R; 431/2; 431/6; 219/10.57

[51] Int. Cl.[2] .. F02P 1/00; F02B 33/00; H05B 9/06; F23N 5/20

[58] Field of Search ..... 219/10.55, 10.57; 123/119 E, 143 B, 148 E; 431/2, 6

[56] References Cited

UNITED STATES PATENTS

| | | | |
|---|---|---|---|
| 2,402,539 | 6/1946 | Eitel | 123/148 E |
| 2,617,841 | 11/1952 | Linder | 123/148 E |
| 2,876,270 | 3/1959 | Lutz | 123/148 E |
| 2,907,648 | 10/1959 | Chapman | 123/119 E |

OTHER PUBLICATIONS

The Effect of Electric Fields on the Burning Velocity of Various Flames, Combustion, Flame 16, pp. 275–285, (1971).

*Primary Examiner*—Charles J. Myhre
*Assistant Examiner*—Ronald B. Cox

[57] ABSTRACT

A technique for increasing the efficiency, and for decreasing the exhaust emissions, of an internal combustion type engine in which substantially rf energy (e.g., $10^6$Hz to $10^{12}$Hz) is generated and coupled to a combusting plasma airfuel mixture (preferably at a plasma frequency) so as to enhance both pre-combustion conditioning of the mixture and combustion reactions.

25 Claims, 21 Drawing Figures

COMBUSTION IN AN INTERNAL COMBUSTION ENGINE

BACKGROUND OF THE INVENTION

1. Field of the Invention

This invention pertains generally to apparatus and a method for increasing efficiency and/or decreasing exhaust emissions of an internal combustion engine.

2. Discussion of the Prior Art

The concern over air pollution and the dwindling of petroleum resources has resulted in legislation which has caused a shift in emphasis from powerful, high compression engines to small, low compression ones. As the degree of pollution which an automobile introduces into the air is measured in parts per mile, a smaller, lower compression engine, burning a leaner mixture (i.e., a higher ratio of air to fuel) can more readily satisfy the pollution requirements.

It is known on the one hand that the level of CO (carbon monoxide) produced by the internal combustion engine decreases as the air-fuel ratio is increased, and continues to decrease beyond the "chemically ideal" ratio of 14.7, and the decrease extends to the "lean limit", i.e., the limit at which flame speed drops to zero and at which the air-fuel mixture does not ordinarily ignite. The production of $NO_x$ (oxides of nitrogen), on the other hand, is most sensitive to the time at which the spark is fired (given in degrees before top dead center, BTDC). The production of $NO_x$ in parts per mile, jumps from approximately 1,000 to 3,000 parts when the spark timing is advanced over a 20° range. In order to reduce carbon monoxide, oxides of nitrogen and also other hydrocarbons, therefore, one must operate the internal combustion engine with an air-fuel ratio lying at the lean end of the scale, and ignite the mixture as close to TDC as possible. The difficulties associated with these conditions are twofold: firstly, as the mixture is made leaner, it will become increasingly more difficult to ignite with the spark, since the spark constitutes a contant external energy source of approximately 0.1 joule/spark energy capacity, and secondly, the resultant drop in flame speed along with spark timing near TDC will result in late combustion of the mixture and hence reduced efficiency as well as increased discharge of unburnt hydrocarbons through the exhaust. (On the other hand it is known that in order to increase engine efficiency as well as decrease exhaust emissions it is very desirable to ignite and sustain combustion of a lean mixture in an internal combustion engine.)

One approach to this problem has been the so-called "CVCC" engine, which utilizes a pre-ignition chamber and an extra carburetor. However this technique has the disadvantage in that mechanical modification of the cylinders and engine is required.

Another approach is discussed in U.S. Pat. No. 2,457,973 issued Jan. 4, 1949 and entitled Ionizing Means and Methods of Ionization. This patent teaches how to effect ionization of a gaseous mixture in the combustion chamber of an internal combustion engine by utilizing in combination with a conventional spark plug a radium cell in close proximity to the firing electrodes and an auxiliary electrode. It can readily be appreciated that, while such a device may reduce the firing potential near the vicinity of the electrode and perhaps extend spark plug life, flame velocity is not increased and it appears that flames propagating in air fuel mixtures below the lean limit will be quenched.

Another apparatus for producing an electric space charge or ionization in the combustion chamber of reciprocating piston type or turbine type combustion engines is disclosed in U.S. Pat. No. 2,766,582 issued Oct. 16, 1956, entitled Apparatus for Creating Electric Space Changes in Combustion Engines. This patent teaches the production of electric space charges in combustible fuel and air mixtures by electrically charging a dielectric type liquid fuel previous to jet spraying from an engine carburetor nozzle or from a spray nozzle in the combustion chamber proper. The electrically charged fuel is subsequently evaporated in space in the combustion chamber. A particular disadvantage of this technique is the generation of space charges in the fuel prior to its injection in the cylinder. This leads to a complex charge generating mechanism and a complex fuel transporting and injecting mechanism into the combustion chamber so as to maintain the charges that were generated in the fuel. Also additional insulating mechanisms are required to prevent charge leakage.

Another prior art device, which provides another means of sparking in an internal combustion engine, is the internal combustion engine ignition system disclosed in U.S. Pat. No. 2,617,841 issued Nov. 11, 1952. This patent discloses an ignition system for internal combustion engines which utilizes "voltages of ultra-high frequency for sparking." (Column 1, lines 3–4.) The teaching of this patent "contemplates that an internal combustion engine be fired by the method comprising the steps of generating high frequency energy, applying the energy to a resonator or resonant circuit, and tuning to the frequency of this energy the resonant circuit in timed relationship with the movable wall member to cause a spark to leap a spark gap in the circuit at resonance of the resonator." (Column 2, lines 43–50, and column 3, line 1.) The main disadvantages of this approach are as follows: (1) since its purpose is to produce the initial breakdown of the air-fuel mixture very high power high frequency devices are necessary to initiate ignition in the cylinder, and accordingly pulse type peak power ignition is necessary, as a practical matter, to handle the power required, and therefore flame speed or avoidance of flame quenching is not necessarily enhanced because of the short duration of the high frequency energy for ignition; (2) energy is coupled to a tuned resonant cavity in which resonance varies, thus requiring precise and complicated timing mechanisms; (3) extensive modification of cylinder design and engine design is necessary; and (4) since ignition occurs as the cylinder volume is decreasing, and not increasing, one will encounter many cavity resonant frequencies before reaching the desired one and considerable pains will have to be taken to insure that ignition does not occur as these other resonant modes are passed.

In view of the foregoing it is a principal object of the present invention to provide a system which increases the efficiency and also reduces the exhaust emissions of an internal combustion engine which can be installed in existing internal combustion engines, with a minimum of engine modification, and is relatively cheap and easy to manufacture and install, and requires relatively low power in operation.

Other objects are to enhance combustion and increase flame speed in the combustion chambers of internal combustion engines and to provide an improved ignition support system for an internal combustion engine.

Other objects and advantages of the invention will become apparent from the following description of particular preferred embodiments of the invention when read in conjunction with the accompanying drawings.

SUMMARY OF THE INVENTION

In one aspect the invention features a system for use with an internal combustion engine having a combustion chamber, means for producing a combustible mixture therein, and means for igniting the mixture. The system comprises an energy source for generating electromagnetic energy at an operating frequency, $f_o$, of the order of (i.e., within two orders of magnitude) the plasma frequency, $f_{ps}$, of a species, s, of charged particles of the mixture, where $$f_{ps} \equiv \frac{1}{2\pi} \sqrt{\frac{n_s e^2}{m_s \epsilon_o}},$$

and where $n_s$ is the species number density of the mixture, $m_s$ is the species mass, $e$ is the charge of an electron, and $\epsilon o$ is the dielectric constant of free space. The system also includes conductor means for conducting the energy from the source to the chamber to couple the energy to charged particles of that species in the mixture during its combustion. Preferably, the species, $s$, consists of electrons; the energy source generates continuous wave (cw) energy which is conducted to the chamber substantially without interruption; the operating frequency, $f_o$, is a weighted average of the plasma frequency of the species in the initial flame front of the combusting mixture and the plasma frequency in the fully developed flame front and/or is a weighted average of the plasma frequency of electrons in the flame front and the electron-neutral collision frequency in the flame front.

In another aspect, such system may comprise an energy source for generating rf electromagnetic energy (where rf energy is energy having a frequency in the range of about $10^6$Hz to about $10^{12}$Hz), means for generating a substantially DC (i.e., frequency $<<10^6$Hz) voltage, and means for conducting the rf energy and the DC voltage to the combustion chamber to precondition the air-fuel mixture for combustion, ignite the mixture, and enhance combustion reactions.

In another aspect, the invention features an apparatus for use with an internal combustion engine having $n$ combustion chambers for the combustion of an air-fuel mixture, where $n$ is an integer greater than zero. The apparatus comprises a plurality of spark plugs, one communicating with each combustion chamber for igniting the air-fuel mixture in each chamber; a source of substantially DC voltage; rf generating means for generating electromagnetic energy having a frequency in the range of from about $10^6$Hz to about $10^{12}$Hz; rf coupling means electrically connected to the rf generating means for coupling the energy to the combusting air-fuel plasma mixture in each of the combustion chambers; and distributor means coupled to each of the voltage source, the rf source, the spark plugs, and the rf coupling means for controllably distributing the DC voltage and the rf energy to the spark plugs and the rf coupling means respectively, in a predetermined timed sequence. The distributor means may take various forms. One embodiment comprises a DC distributor with $n$ additional electrical conductors located for sequential communication with the distributor rotor and a control unit connected to receive as inputs signals from each of those additional conductors. The control unit controls the distribution of the rf energy to the appropriate portion of the rf coupling means for transmission to the appropriate combustion chamber dependent upon the inputs received from the additional conductors. In another embodiment the distributor means comprise a coaxial transmission line E1 section having inlet and outlet ports and being rotatable about the axis of the E1 segment including said inlet port. The E1 section is connected to receive both the DC voltage and the rf energy from connections disposed along the axis of rotation and to distribute them sequentially to conductor means disposed around the path of rotation of the outlet port, the E1 section being rotationally driven in timed relation with the operation of the engine.

In one preferred embodiment of the invention apparatus as discussed above comprises a housing internally segmented into n compartments (for use with an engine having $n$ combustion chambers) and a rotor disposed in the housing and having a portion which successively sweeps through each of the compartments during its rotation in timed relation with the operation of the engine and being electrically connected to a source of DC voltage. Each compartment of the housing contains: a source of rf energy; a coaxial conductor for conducting both the DC voltage and the rf energy to a combustion chamber of the engine; conductor means coupling the source of RF energy to the coaxial conductor and including DC blocking means; a communication point which electrically connects the rotor with the inner conductive means of the coaxial conductor; actuating means for actuating the source of rf energy at a predetermined orientation of the rotor with respect to the compartment; and rf energy filtering means disposed in the electrically conducting path between the source of rf energy and the rotor.

In another aspect, the invention features the method of operating an internal combustion engine comprising the repeated steps of, for each combustion chamber, supplying an air-fuel mixture to the chamber, the fuel component of which comprises a fuel having a permanent electric dipole moment having resonances in the rf frequency region, compressing the mixture, coupling rf energy to the mixture at frequencies which include at least one of the resonances, igniting the compressed mixture, and exhausting the combustion products from the chamber. Preferably, the fuel component comprises methanol and the coupling continues throughout all of the other recited steps.

BRIEF DESCRIPTION OF THE DRAWINGS

The invention will be described with reference to the accompanying drawings wherein.

DESCRIPTION OF PARTICULAR PREFERRED EMBODIMENTS

General

Figure 1:
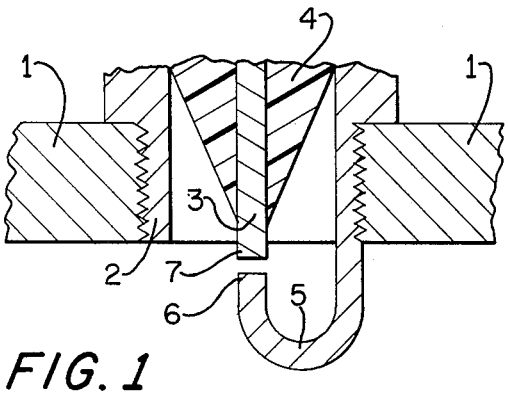
FIGS. 1–7 are somewhat schematic drawings of different types of spark plug tips which are utilized in the invention to produce an igniting spark as well as couple rf energy to the air-fuel mixture.

In accordance with the present invention, high frequency electromagnetic energy denoted as "rf" or "RF" (e.g., about $10^6$Hz to about $10^{12}$Hz), preferably of order $10^2$ watts CW (i.e., $10^1$ watts to $10^3$ watts) power level, is coupled into the engine cylinder of a conventional internal combustion engine either through the spark plug itself or in the vicinity of the spark plug tip, and by operating in such a manner requires no mechanical modification of the internal combustion engine, with the exception of minor changes in the design of the distributor and associated wiring.

The energy is preferably produced by magnetrons or microwave solid-state devices in the microwave region of the spectrum, although other high-power RF sources such as travelling wave tubes, other cross-field devices, and power klystrons could be utilized. In the lower frequency range (1–500 MHz) the more conventional tube oscillators could be used. They will not be specifically discussed as the emphasis will be on the microwave region of the rf spectrum, but it is to be understood that the lower frequency devices would replace the cavity type devices (e.g., magnetrons), or the solid-state devices, whenever lower frequency operation is preferred, and the replacement is made without modification of the circuit configuration except in the cases where the characteristic shape or size of the microwave source constitutes an essential element of the circuit. Furthermore, the operation of two or more different devices at different frequencies (e.g., 30 MHz and 3 GHz), and perhaps under different operating conditions (pulsed and CW), simultaneously to further enhance combustion in various circumstances is, of course, within the scope of the present invention.

The microwave energy source can act in conjunction with the mechanically linked action of the distributor rotor shaft and obtain its timing information thereform. The microwave energy is coupled in turn into each combustion chamber for an interval of time containing the instant at which that combustion chamber is fired, or for a period of time before, after, or before and after the instant the combustion chamber is fired by means of the spark at the spark plug tip. The presence of the microwave energy at or near the spark plug tip modifies the voltage required for firing. It may even be possible to eliminate the spark altogether by using microwave sources in the pulsed mode, and by designing the spark plug tip in such a manner that it both couples microwave energy efficiently to the air-fuel plasma mixture as a whole as well as produce large electric fields at a highly localized region of the spark plug tip. However, in such a method of operation the distributor or other devices such as the harmonic balancer, camshaft, or crankshaft are essential as timing devices to trigger the microwave generator into both a pulsed (high power) mode of operation and CW mode at the time when the spark is to occur. This invention concentrates on the method of coupling CW microwave energy to a combusting plasma mixture. In order to better understand the effects that the invention will produce on a combusting air-fuel plasma mixture, a brief discussion of the interaction of the RF fields and the plasma particles will be given below.

When a DC potential is applied between two electrodes, electrical forces will act to dissociate, excite and ionize the atoms and molecules of a gas between the electrodes as well as accelerate any charged particles present. The gas goes through various states of activation as the voltage is increased, most notably the Townsend discharge, Corona, Normal Glow and Arc. The onset of these processes will be lumped together in the generic term "breakdown". Therefore, electrical fields are spoken of as initiating breakdown of the gas, and sustaining it by accelerating ions and electrons which interact with atoms and molecules to dissociate, excite and ionize the gas. The breakdown field $E_b$ as a function of pressure (Paschen curve) has a minimum which is weakly dependent on various parameters including frequency. But for the present purposes (pressure $p > 100$ torr), Eb increases substantially linearly with pressure and one may write the approximation: $E_b$ (volts/cm) $= 30p$ (torr)

which gives an $E_b$ of approximately 20 kvolts/35 mil at a pressure of 10–15 atmospheres. But according to the present invention microwave energy is employed in both enhancing breakdown and increasing the speed of phenomena associated with the resultant breakdown in a combustible mixture, most notably the propagation of the flame front. Therefore a brief discussion of the advantages of high-frequency over DC electrical energy will be given before proceeding with these more detailed discussions. (The term "DC", as used herein includes low frequency, $f_d$c, where that low frequency $f_{dc}$ satisfied the condition $f_{dc} << 10^6$ Hz.)

As one increases the frequency of the electric field, initially no unexpected change in the characteristics of the discharge is observed. However, a critical frequency, $fc_i$, is reached at which the ions no longer have time to drift to the cathode and be lost, but instead will oscillate in the gap continuously producing dissociation, excitation and ionization. This type of breakdown is known as "mobility controlled." After a further increase in the frequency, $fc_e$, the frequency at which the electrons are no longer lost to the wall, is reached. This type of breakdown is known as "diffusion-controlled," and is believed the one which governs the electron-field interaction in this invention, although the mean free path of the electrons is further reduced due to collisions with the neutrals. Now, it is known that the concentration of ions and electrons in combusting mixtures at atmospheric pressure is approximately $10^{10}$ charged particles/cm$^3$ (G. Wortberg (1965), 10$^{th}$ Int. Symp. Combust., p. 651), and varies with the composition of the fuel. Furthermore, the mole fraction of ions is virtually independent of pressure (J. Lawton and F. J. Weinberg, (1969), Electrical Aspects of Combustion, p. 215). The electron and ion plasma frequencies associated with these charge densities lie in the microwave and vhf frequency range respectively; the electron-neutral collision frequency lies in the microwave range. The plasma frequency, $f_{ps}$, of a charged species, s, is defined as:

$$f_{ps} = \frac{1}{2\pi} \sqrt{\frac{n_s e^2}{m_s \epsilon_o}}$$

where $n_s$, $m_s$ are the species number density and mass respectively, $e$ is the electronic charge, and $\epsilon o$ is the dielectric constant of free space. In addition the plasma and collision frequencies in the vicinity of the flame front fall off with a smooth profile. Once the spark produces the initial breakdown, the microwave energy penetrates the electron density profile, the depth of penetration depending on the operating frequency, plasma frequency and collision frequency. In the process of penetration of the wave, the electrons will be accelerated and will in turn collide with the neutral particles and the combusting plasma mixture will present a large, low Q load to the microwave energy, where Q of a system may be defined as:

$$Q = \frac{2\pi f \text{ (time-average energy stored in system)}}{\text{energy loss per second in system}}$$

where $f$ is the frequency of the microwaves. In fact, if an electrically short cylindrical probe (e.g. probe 10 of FIG. 5) is used to couple the microwave energy to the plasma, it will see an input impedence $Z_{in}$, where $$Z_{in} \alpha \frac{1}{j} \frac{1}{\text{CU-Z,16-/19}} \quad 1 - \frac{f^2 pe}{f^2} \quad \frac{1}{1 - j\frac{ven}{2\pi f}}$$

where $f_{pe}$, $\nu_{en}$ are the electron plasma and collision frequencies respectively, and $j = \sqrt{-1}$.

In this way microwave energy will be coupled to the combusting plasma mixture and will aid in sustaining combustion in a lean mixture, and increase the flame speed. One can picture an initial flame front, which would ordinarily quench, being sustained by the microwave energy which penetrates the plasma associated with and tied to the flame front, and which accelerates the electrons which in turn collide with the combustible molecules and produce excitation (electronic and mechanical) and dissociation from which further combustion exothermal reactions result. The optimim effect, it is believed, obtains when RF power near the frequency corresponding to approximately the peak electron-plasma frequency is coupled to the plasma at the flame front. This peak will vary between that corresponding to the initial combusting mixture and that of the fully developed flame front. By choosing the operating frequency to correspond to the electron plasma frequency between those two extremes, but closer to the lower frequency initial plasma, one probably obtaines optimum enhancement of the combustion. On the average, this frequency corresponds to a value roughly midway down the electron plasma frequency profile where flame enhancement is desirable. Finally the combustion process is enhanced when one can excite vibrational rotational or other resonances of the petroleum molecules directly with the microwave energy by operating the microwave sources at frequencies corresponding to the molecular resonances. Most petroleum molecules are non-polar and do not exhibit microwave resonances. However, alternative fuels such as methanol do possess a permanent electric dipole moment and exhibit many resonances in the microwave region. Furthermore, methanol is a substantially cheaper fuel than gasoline and, in the form of a gasoline-methanol mixture, performs as well as the more expensive pure gasoline. Thus, by exciting the gasoline-methanol mixture with microwave energy, one can enhance the breakdown of the fuel mixture and improve its combustion properties.

As already stated, the existence of microwave energy at or near the spark plug tip will improve the characteristics of the spark. Defining the component of the microwave energy found at the spark plug tip as the "non-resonant component", and that which exists in the main volume of the cylinder as the "resonant component", the resonant component depends on the coupling efficiency of the loop or probe to the combusting plasma mixture.

The spark is initiated when the contact points open and the order of 10 kilovolts is applied across the plug gap. This is known as the capacitive component of the spark; it is of very short duration, and is responsible for the breakdown of the mixture and initiates combustion in a well distributed mixture with an ignitable air-fuel ratio. The capacitive component is followed by the inductive component, which lasts approximately 20° of crankshaft rotation and is characterized by a reduced voltage of order 1 kilovolt and by the presence of current which gives rise to the visible spark one commonly sees. The inductive component contains most of the energy of the spark, and is important in the ignition of a wet cold mixture or a lean mixture.

Now, it is expected that the non-resonant component of the microwave energy will produce large, non-uniform time-variant field gradients at the spark plug tip which will effectuate production of Corona type discharge characterized by streamers of ionization at the plug tip. These streamers reduce the breakdown voltage which is associated with the capacitive component of the spark, and the resultant drop in the peak voltage required to initiate combustion will simplify the design and production of the circuits which are necessary to isolate the high secondary voltage from the RF source. Moreover, by appropriate choice of plug gap size and shape, mode of operation of microwave source, and frequency, one can increase the energy capacity and density of the inductive component, which results in more efficient and cleaner operation by virtue of improved combustion of wet cold mixtures and more important, by improved combustion of lean mixtures, since most efficient operation of the internal combustion engine is known to occur at air-fuel ratios of approximately 17. In addition, if power microwave sources are used in the moderate power pulse mode (but with large pulse widths), then one can maintain the high power, high voltage fields for a few degrees of crankshaft rotation as compared to the very short lived high voltage capacitive component of the DC spark, and hence maintain the breakdown fields for a considerably longer time. This factor is further multiplied since one can supply a substantially larger total spark energy with the microwave source, e.g., 1 joule/spark instead of just .1 joule/spark.

DESCRIPTION OF THE DRAWINGS

Figure 3:
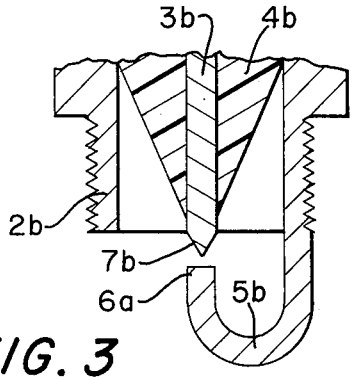
Figure 4:
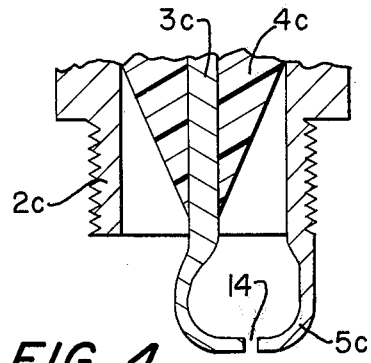
Figure 5:
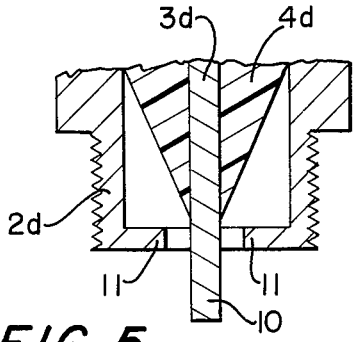
Figure 6:
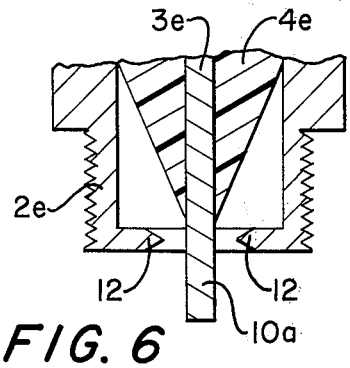
Figure 7:
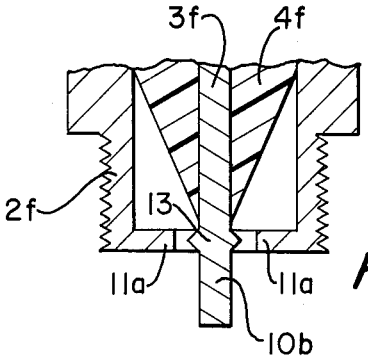

Referring now to FIGS. 1–7 there are shown several different types of spark plug tips that may be utilized with the invention to produce the spark as well as introduce the microwave energy into each combustion chamber. In general, there are two principle methods utilized to couple rf energy to this plasma within the cylinder: loop and probe coupling. FIGS. 1–4 are of the loop coupling variety whereas FIGS. 5–7 are of the probe coupling variety. Referred now to FIG. 1 there is shown the engine cylinder head 1 having a normal spark plug opening which is threaded to receive the outer-casing 2 of the spark plug. The inner conductor 3 is separated from the outer casing 2 by a space which is partially filled by insulating material 4 such as a ceramic. The loop portion 5 forms a continuation of the outer conductor 2 and provides an air gap between the tip 7 of inner conductor 3 and the tip 6 of loop 5. The gap between tips 6 and 7 provides the large electric field gradients produced by the DC voltage and microwave energy which ignite the air-fuel mixture and the loop 5 couples the microwave energy to the combusting plasma mixture to enhance combustion.

Figure 2:
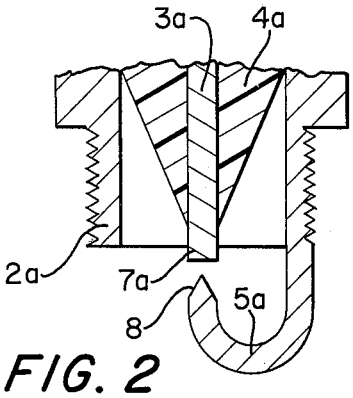

FIGS. 2 and 3 are similar to FIG. 1 and have similar components wherein the threaded outer casing of the spark plug in FIGS. 1, 2 and 3 are number 2, 2*a* and 2*b* respectively; the inner conductor of the spark plug of FIGS. 1, 2 and 3 are numbered 3, 3*a*, and 3*b* respectively; and the insulation of FIGS. 1, 2 and 3 are numbered 4, 4*a* and 4*b* respectively. Note, however, that there is a difference in shape between tips 6 and 7 of FIG. 1, tips 7*a* and 8 of FIG. 2 and tips 6*a* and 7*b* of FIG. 3. FIG. 2 has tip 8 of loop 5*a* pointed whereas FIG. 3 has tip 7*b* of inner conductor 3*b* pointed. This arrangement provides for lower DC sparking voltage by providing a greater concentration of charges at the pointed tip thus inducing corona discharge at a lower voltage.

FIG. 4 is also similar to FIGS. 1, 2 and 3 and has corresponding components 2*c*, 3*c* and 4*c;* however it will be noted that the spark gap is at the bottom of loop 5*c* since the location of the spark gap along the loop is immaterial. It is to be understood that the cross section of the inner and outer conductors may be circular as in spark plugs currently available or of any other convenient shape.

FIGS. 5–7 show the probe coupling type of plug wherein the center conductor 3*d*, 3*e* and 3*f*, of FIGS. 5, 6 and 7 respectively are each separated from their outer conductors 2*d*, 2*e* and 2*f* by a space partially filled by an insulator 4*d*, 4*e* and 4*f* respectively. FIGS. 5–7 are essentially the same with the exception that in FIG. 6 the tip 12 of outer conductor 2*e* is pointed whereas in FIG. 7 the pointed tips 13 are incorporated within the center conductor 3*f*. The probe portion of the spark plug 10, 10*a* and 10*b* of FIGS. 5, 6 and 7 couple microwave energy to the plasma mixture whereas the spark takes place between the gap formed by the tip 11, 12 and 11a of FIGS. 5, 6 and 7 respectively and the center conductor 3*d*, 3*e* and 3*f* respectively. It should be noted that in FIGS. 2, 3, 6 and 7 the DC ignition is aided by the rf energy concentrated at the pointed tips and may also be utilized with pulse type microwave energy for providing high power microwave energy to ignite the mixture as well as to sustain existing combustion and increase flame speed. In all cases the optimum shape and size of the coupling loops and probes are determined by such factors as the frequency of the microwave energy, the required degree of coupling of the energy to the plasma, and required intensity of field at the plug tip (i.e., the ratio of resonant to non-resonant component of the microwave energy). These factors can easily be determined by standard electrical measuring techniques.

The spark plugs of FIGS. 1–7 may be incorporated in spark-ignited internal combustion engines including less conventional ones such as the rotary engine, the "Rotary V" engine, the CVCC engine, and others. In the case of the CVCC engine, which possesses two spark plugs per cylinder, it would be preferably to introduce the rf energy through the spark plug belonging to the precombustion chamber as it contains the primary ignitable richer mixture. In the case of diesel engines the microwave energy could be introduced through a glow plug which is in the form of a loop as shown in FIG. 4 but with the spark gap 14 omitted. In this instance the microwave source would have its timing control tied to the injection time of the fuel into the cylinder.

Figure 8:
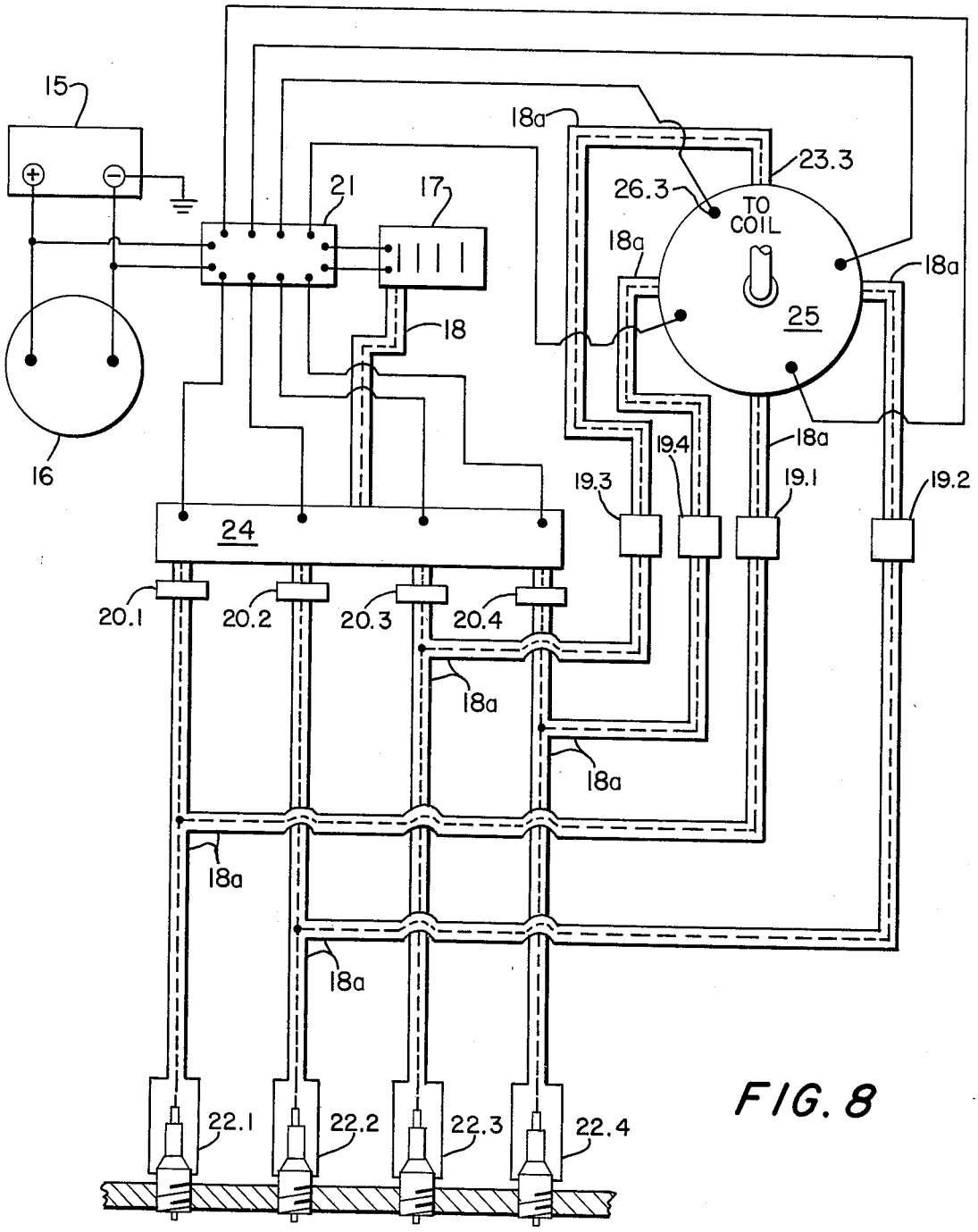
FIG. 8 is a schematic drawing of one embodiment of the invention installed on a four cylinder internal combustion engine.

Referring now to FIG. 8 there is shown the high frequency (rf) power oscillator or generator 17 which may be one of many available, such as the G. & E. Bradley Ltd. 420 to 439 oscillators, Engelmann Microwave Co. (a subsidiary of Pyrofilm Corp.) CC-12, 24-Series, or others used in conjunction with, for example, the Microwave Power Devices, Inc. solid state high power Amplifiers series PA or CA. Many inexpensive microwave sources, including solid states types, of the order of 100 watts CW are currently commercially available and constantly being developed. Typically the solid state power oscillator requires an operating voltage of 12–45 volts DC which is supplied by the battery 15 during starting. An automobile alternator 16 coupled to the battery 15 and to the control box 21 supplies the DC voltage when the engine is running. A one-pole four-throw (1P4T) remotely actuated coaxial relay switch 24 is coupled to the microwave oscillator 17 via coaxial cable 18. (For an "n" cylinder engine one would use a 1 P"n"T switch or one could cascade several switches). If more than one rf source is used, then the number of required throws associated with each switch are reduced. Of course no switches are required if one rf source per cylinder is used, as further discussed below. In addition, for single chamber engines such as the single cylinder rotory engine (Wankel), a switch is not required. The control unit 21 is coupled to the microwave generator 17 to control the timing for introducing microwave energy into the various cylinders. This unit will be more fully described below in relation with FIG. 10. A distributor 25 (to be more fully described below in relation with FIG. 9) provides the timing for introducing the DC electrical energy into each cylinder. Coaxial cables 18a electrically couple the remotely actuated coaxial relay switch 24 with the spark plugs 22.1, 22.2, 22.3 and 22.4 which may be of any of the type previously discussed with relation to FIGS. 1–7. These are utilized to provide the microwave energy from the microwave generator 17, through the coaxial relay switch 24 to each cylinder. High voltage DC blocks 20.1–20.4 are provided on the coaxial lines 18a between the coaxial switch 24 and the spark plugs 22.1–22.4 to insure that high voltage does not reach the microwave power oscillator 17 but allow the microwave energy to propagate with small reflection. The distributor 25 which distributes the DC high voltage to each cylinder is coupled via coaxial cables 18a to spark plugs 22.1–22.4. Power rf filters 19.1–19.4 are provided in coaxial cables 18a between distributor 25 and spark plugs 22.1–22.4 to insure that rf power does not reach the distributor and the environment, but are designed to carry without breakdown the high voltage DC.

Figure 9:
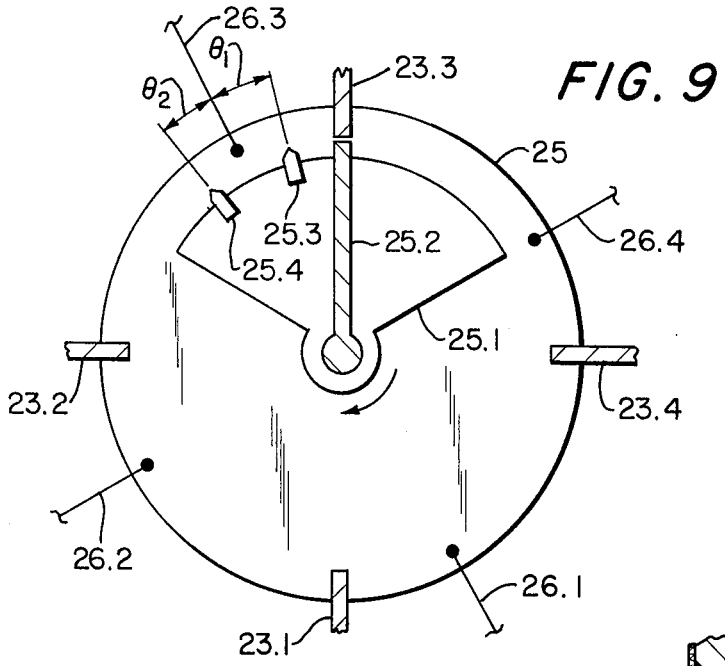
FIG. 9 is a detailed drawing of the distributor 25 of FIG. 8.

Referring now to FIGS. 8 and 9 a complete cycle associated with the firing of a cylinder (in this case cylinder (not shown) associated with the third spark plug 22.3) will be given below. As the distributor rotor 25.1 turns clockwise, actuator 25.3 actuates switch 26.3 and activates the power oscillator 17 as well as coaxial switch 24, by means of control unit 21 (to be later more fully described) to transmit microwave power to spark plug 22.3 which is located in an aperture on the third cylinder. The low pass filter 19.3 prevents the RF power from passing to the distributor 25. After a specified rotation $\theta_1°$ of the distributor rotor 25.1, points (not shown) open. The DC high voltage terminal 25.2 from the coil secondary winding (not shown) is aligned with terminal 23.3, so that the DC high voltage is transmitted to spark plug 22.3. Blocking capacitor 20.3 protects the oscillator from the DC high voltage. After a further rotation $\theta_2°$ of rotor 25.1, actuator 25.4 turns switch 26.3 and the oscillator off, and the firing of spark plug 22.3 coupled to the third cylinder is complete. The actuators 25.3, 25.4 and switches 26.1–26.4 may be of any various types such as magnetic reed switches, optically actuated switches, etc.

Referring once again to FIGS. 8, 9 and also 10, a more detailed description and operation of control unit 21 is given. When the actuator 25.3 actuates switch 26.3 (which may be a normally open magnetic reed switch) a voltage proportional to $R_2/(R_1 + R_2)$ (where $R_1$, $R_2$, $R_3$ are values of resistors $R_1$, $R_2$, $R_3$) is applied to switch 21.1. (Switch 21.1 may be a Thyratron switch, a Kytron, an SCR, or any other high power high speed switch, such as a DC controlled No. 700 series Solid State Hamlin relay capable of switching 25 amps and several KW within a milisecond). When switch 21.1 closes, DC power is transmitted to power oscillator 17 in order to activate it. Substantially simultaneously a voltage proportional to $R_1/(R_1 + R_2)$ is applied to terminal 24.3 of high speed coaxial switch 24 and engages its output to the input coaxial junction 24.5 so that microwave power is transmitted through the switch 24 to the corresponding spark plug 22.3, FIG. 8. When switch 26.3 is deactivated, voltage is removed from switch 21.1 and coaxial switch 24.

Figure 10:
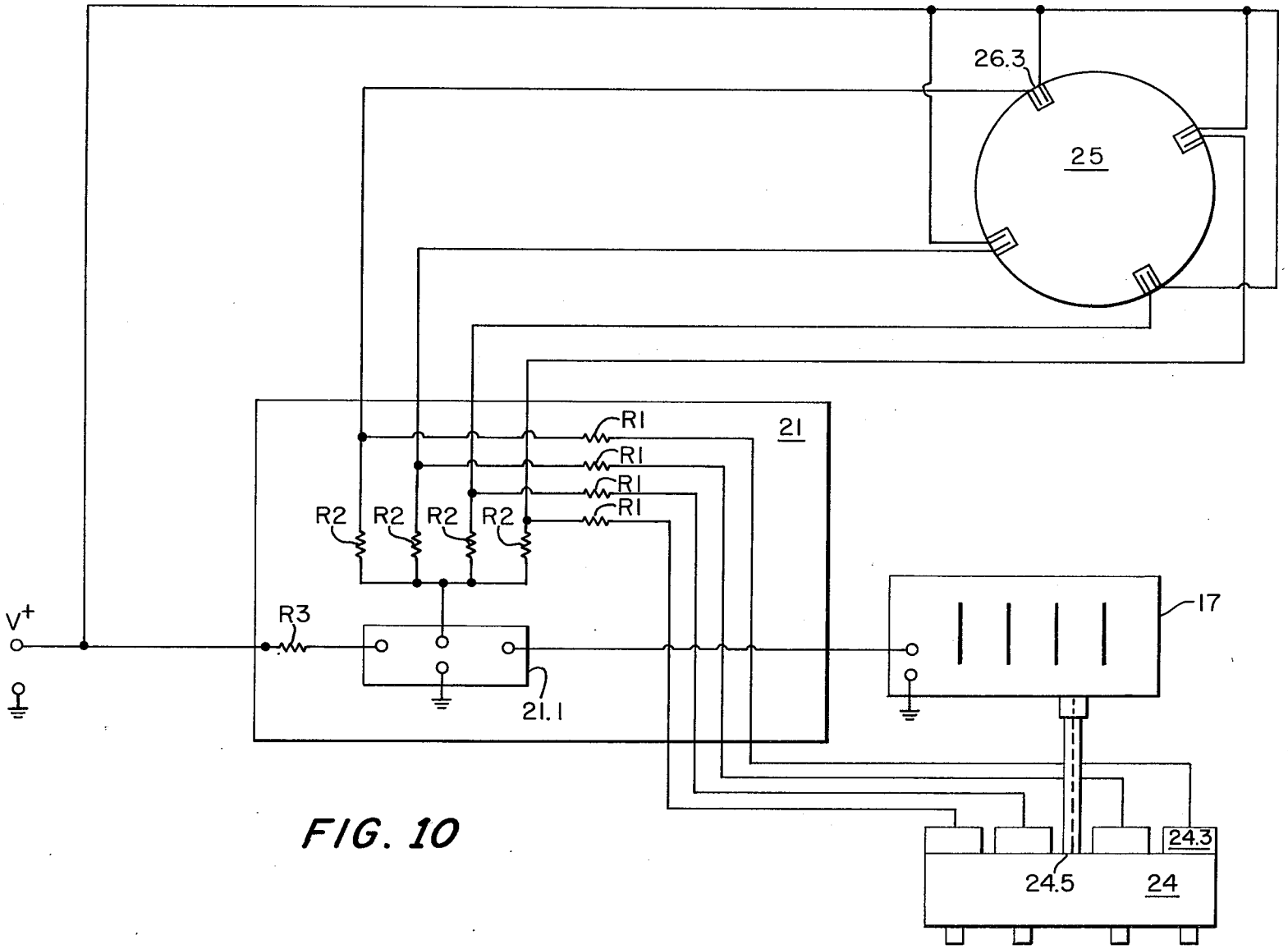
FIG. 10 is a detailed schematic drawing of the control box 21 of FIG. 8.

The circuit of FIG. 10 requires the use of remotely actuated coaxial relay switches capable of withstanding high voltages. Simpler circuits requiring smaller voltages and simpler design will now be considered, which may require varying degrees of mechanical modification of the engine.

Figure 11A:
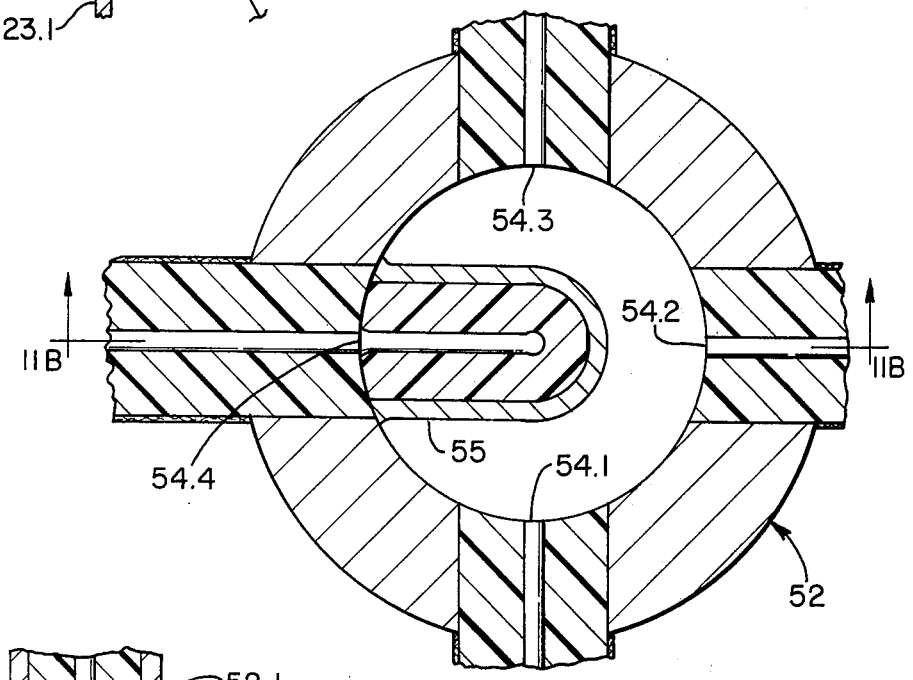
FIG. 11A is a detailed schematic drawing of a modified distributor utilized in the invention for conveying rf energy as well as DC energy.
Figure 11B:
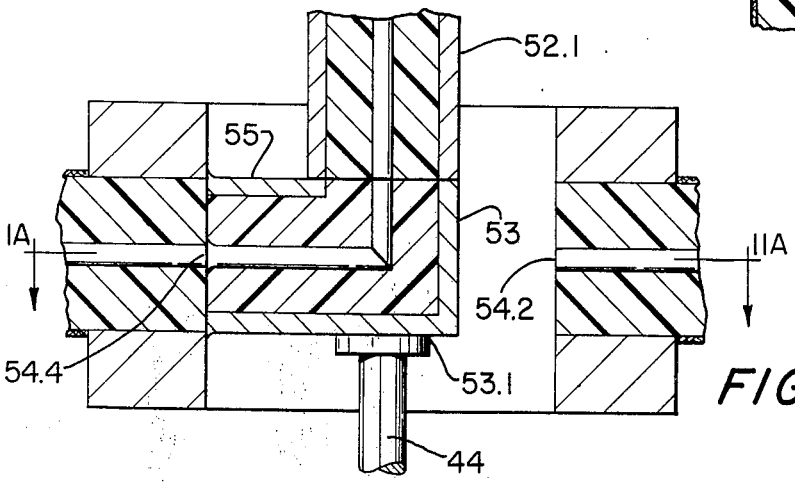
FIG. 11B is a view taken at 11B—11B of FIG. 11A.

The first configuration that is considered is a specially designed distributor that eliminates the need for a high power, fast coaxial switch. FIGS. 11A and 11B show a modified distributor 52 which uses the principle of conveying the RF energy to each spark plug in the same manner in which the DC high voltage is conveyed.

Both the high voltage DC and the microwave power are transmitted down the coaxial cable 52.1 to the special design rotor 53 which is similar to the E1 section of transmission line. Rotor 53 is connected to the rotor shaft 44 and rotates with it. The DC and rf power are transmitted to the spark plug (not shown) and plug tip, which may be among any of those depicted in FIGS. 1 to 7, when the rotor tip 55 aligns with any of the conductors 54.1 to 54.4. The time interval over which the rf energy is made available (to conductor 54.4 in FIG. 11A) is controlled by connecting rotor shaft 44 to rotor 53 by means of an eccentric rotating mechanical connector 53.1, so that the rotor tip 55 may be stationary or relatively slowly moving with respect to the end of the coaxial cable 54.4 for a few degrees of rotor rotation. Also, a conventional or modification of a conventional, manual rotary coaxial switch may be used with distributor 25 and mounted concentric to the rotor shaft 44 to convey the the microwave energy to each cylinder in turn in time with the DC spark.

Figure 12:
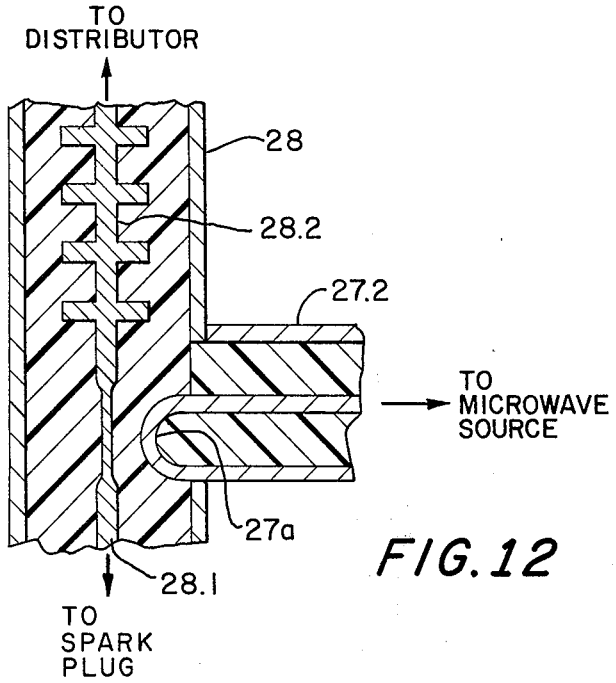
FIG. 12 is a detailed drawing of a capacitively loaded section of a transmission line utilized in the invention as an rf filter.

Referring now to FIG. 12 there is shown a device for achieving DC isolation of the rf source and rf isolation of the distributor. This device may be substituted for each low pass filter 19.1 to 19.4 and each high voltage DC blocks 20.1 to 20.4 of FIG. 8; whereas the distributor 52 of FIG. 11 may be substituted for distributor 25 of FIG. 8. Microwave energy is loop coupled through loop 27*a* (or alternatively probe coupled by replacing the loop 27*a* by a probe (not shown)) to the spark plug (not shown) and hence insures isolation of the microwave source from the hot side 28.1 of the DC high voltage arriving from the distributor. On the distributor side of the rf-DC junction a filter 28.2 is included to prevent the rf energy from reaching the distributor and environment. The device of FIG. 12, a capacitively loaded section of transmission line (28.2), is utilized as the RF filter. Such a periodic structure exhibits passband-stopband characteristics, and is designed to operate at the center of a stopband and hence to filter out the microwave energy travelling towards the distributor.

Figure 13:
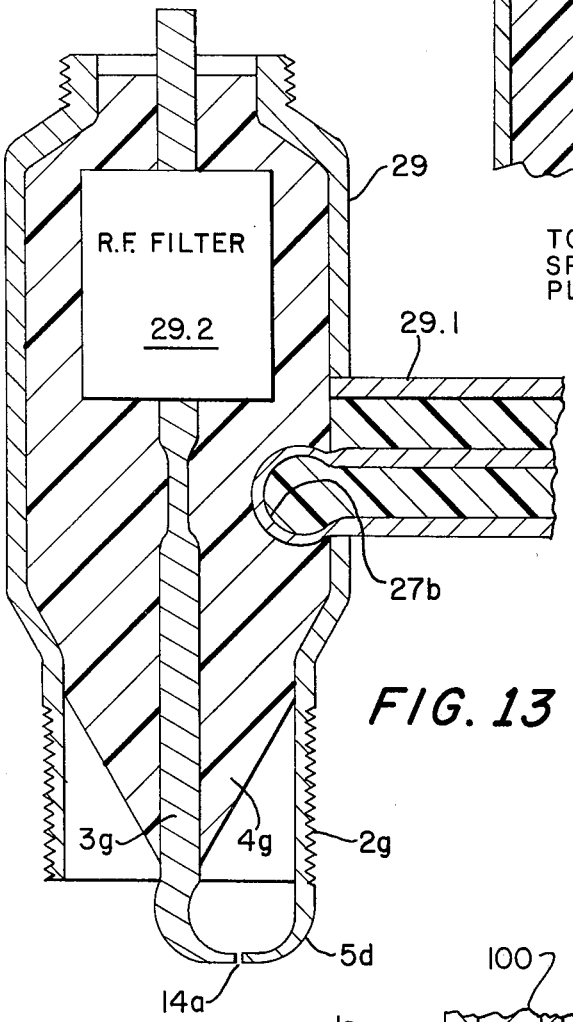
FIG. 13 is a partially schematic detailed drawing of a spark plug for coupling RF energy directly to the spark plug rather than the DC cable of the engine.

Referring now to FIG. 13 there is shown a spark plug 29 which combines the RF filtering action and the DC choke of the previous device with the spark plug which introduces DC and RF voltages to the air-fuel mixture in the cylinder. This plug includes an RF filter 29.2 as part of its construction. This filter may be any of a number available (such as 28.2, FIG. 12) and serves to prevent the microwave energy from reaching the distributor and the environment. In addition, by adjusting the distance between the coupling loop 27*b* and the plug tip 14*a*, one can further control the coupling of the microwave energy to the spark plug tip 14*a*. In place of the loop 27*b*, one can use a probe coupling configuration as previously discussed. If a direct connection is made to the hot side of the conductor 3*g* then obviously a DC blocking capacitor must be placed between the cable 29.1 and the microwave source (not shown in FIG. 13). Inside DC Block Coaxial Connectors are currently available, and utilize capacitance in series with the center conductor and exhibit low VSWR (voltage standing wave ratio) in the microwave frequency range (since Reactance is proportional to 1/Frequency), and can operate at a maximum voltage of approximately 1 KV. By utilizing dielectrics such as Teflon, Mica (high puncture voltage dielectrics), and by making minor changes in the design, the DC Block Coaxial Connectors can be made to operate at higher voltages.

Figure 14:
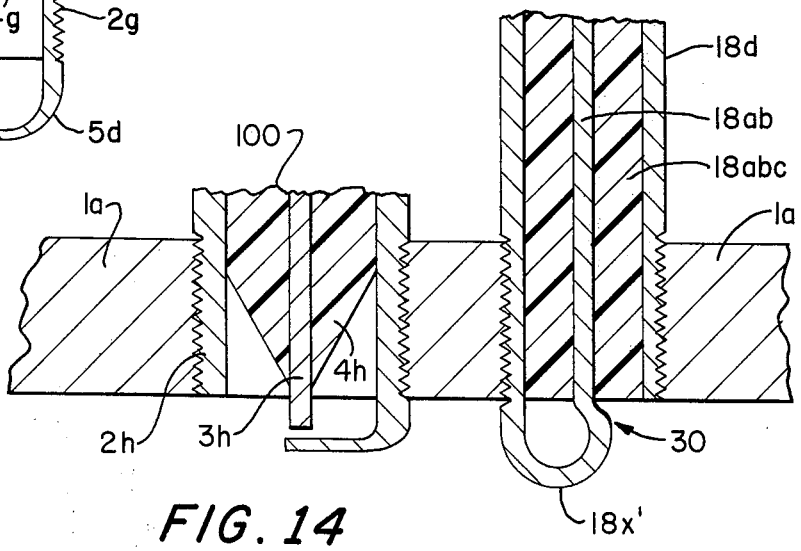
FIG. 14 illustrates another embodiment of the invention for coupling rf energy to a cylinder of an internal combustion engine utilizing a separate port from that utilized by the spark plug.

FIG. 14 illustrates a substantially different method of introducing the microwave energy to the combustion chamber, i.e. coupling the RF energy through a hole adjacent to the spark plug hole rather than through the spark plug itslef. While such an arrangement does not make RF energy directly available to the spark plug tip, it is advantageous in that it does eliminate the need for DC blocks. It still requires a Coaxial Switch, as discussed, as well as a timing mechanism of the type depicted in FIG. 11 (for engine utilizing distributors). For the types of diesel engines which do not use a glow plug, it would be essential to introduce the RF energy in the manner shown in FIG. 14.

Referring to FIG. 14, two threaded apertures in the top of a cylinder head 1a of a spark ignition engine are provided. One aperture receives a conventional spark plug 100 for providing DC ignition to the air-fuel mixture. It is a conventional plug having standard elements such as outer casing 2*h*, inner conductor 3*h*, and insulation 4*h*. The other aperture receives an RF loop coupling plug 30 for coupling RF energy to the combusting plasma mixture. The RF loop coupling plug consists of a partially threaded, outer, electrically conducting casing 18*d*, an inner conductor 18*ab* separated from the casing 18*d* by insulating material 18*abc*. A loop of conducting material 18*x'* connects the outer casing and the inner conductor and serves to couple RF microwave energy to the combusting plasma in the cylinder. (A probe coupler, of course, can be substituted in place of loop 18*x'*.)

The next order to simplification is to make use of the small size of the microwave solidstate devices and use them in configurations that eliminate the need of DC blocks (FIG. 17 no. 39) or coaxial switches (FIG. 8 no. 24).

Figure 15:
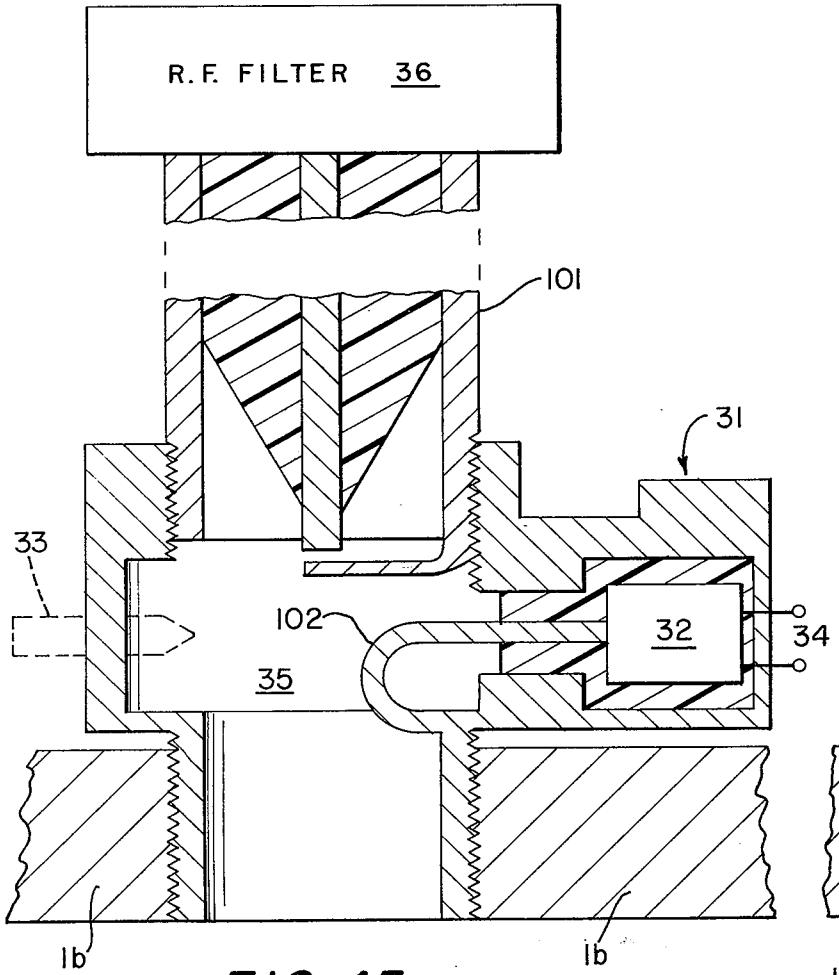
FIG. 15 is a partially scematic drawing of still another embodiment of the invention which eliminates the need for bias insertion units (i.e., a DC block) or coaxial switches.

FIG. 15 shows such an arrangement. A small metallic member 31 is attached to the cylinder head 1b in place of the spark plug, while the spark plug 101 itself is attached to the member 31 as shown. The Microwave Solid State Device 32 (MSD for short) is contained in the member 31 as shown, and may be attached to a heat sink and cooling fins (not shown) to keep its temperature within specifications. The MSD obtains its timing and power through wires 34, which are connected to the distributor or other timing device. The microwave energy is coupled into cavity 35 within member 31 by loop 102 (or alternatively by a probe geometry). The spark plug 101 and the engine cylinder also communicate with cavity 35. A fuel injector 33 (shown in broken lines to indicate that it is an option) may be provided on member 31. An RF filter 36 is placed beyond the spark plug 101 to prevent any RF energy from being coupled by the spark plug 101 and transmitted down the coaxial cable (not shown) connected to the spark plug 101. The orientation of the spark plug and MSD (shown at "12 o'clock" and "3 o'clock", respectively) with respect to the cavity 35 is arbitrary. The arrangement of FIG. 15 is advantageous in that it is compact and it locates the RF energy introduced by the combination of the MSD 32 and coupling mechanism 102 near the tip of spark plug 101.

Figure 16:
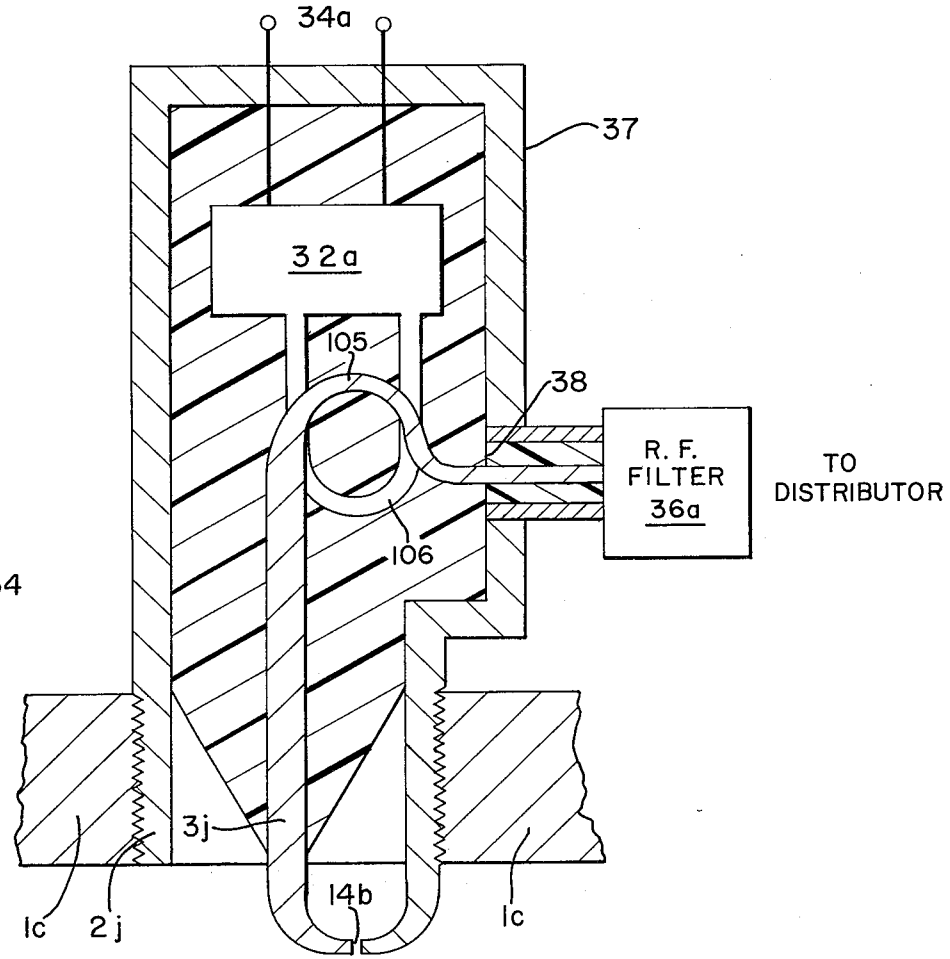
FIG. 16 is a partially schematic drawing of still another embodiment of the invention which elminates the need for bias insertion units or coaxial switches and which contains the rf source in a compact manner.
Figure 17:
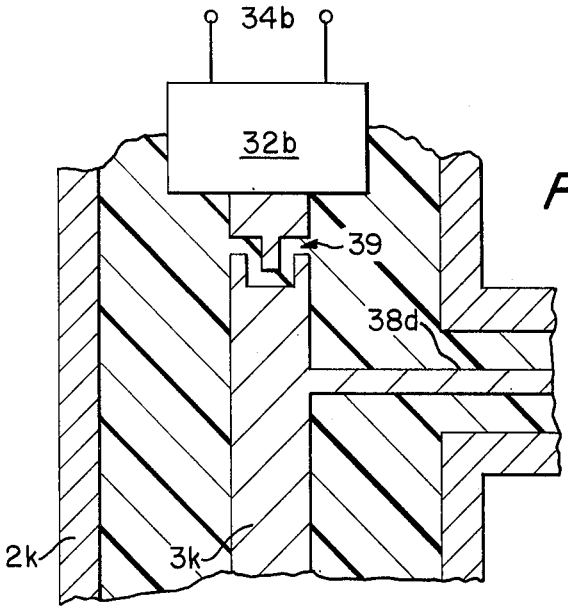
FIG. 17 is a partially schematic drawing of a probe coupling device utilized in the invention.

Another device that utilizes the small size of the MSD is shown in FIG. 16. The device 37 is similar to that of FIG. 15 but lacks the threaded hole for the spark plug 101, as it is in itself a modified form of a spark plug. It makes the DC spark connection at the side 38 via center conductor 38 and again an RF filter 36*a* is required to prevent RF energy from travelling to the distributor and environment. The MSD 32a is shown at the top part of device 37 and is designed to couple RF energy efficiently to the plug transmission line 2j/3j and to the plug tip 14*b* via RF loop coupling means 105 and 106 respectively. Again, a heat sink and cooling fins may be used with the MSD. The loop coupling mechanisms 105 and 106 depicted FIG. 16 is only an example of a possible means of coupling the rf energy to the coaxial transmission line, made up by the center conductor 3*j* and the conducting walls 2*j*, and a probe coupling means may be used. An example of such a device is shown in FIG. 17. Note again that the orientations of MSD 32*a* and cable 38 are arbitrary.

Note that the insulating material depicted in FIG. 16 and shown to extend to the base of the cylinder head 1c may terminate along any distance along the length of device 37 so as to form an air cavity similar to cavity 35 of FIG. 15. FIG. 17 shows a probe coupling arrangement 39 between the MSD 32*b* and the central conductor 3*k*. At the high microwave frequencies the series reactance introduced by the gap 39 will be small. The rf energy is then transmitted down the transmission line 2*k*–3*k* and becomes available at the plug tip (not shown) such as 14*b*, FIG. 16. The device 32*b* is a microwave power oscillator, and 38d is a conductor along which the high voltage DC is carried.

Figure 18:
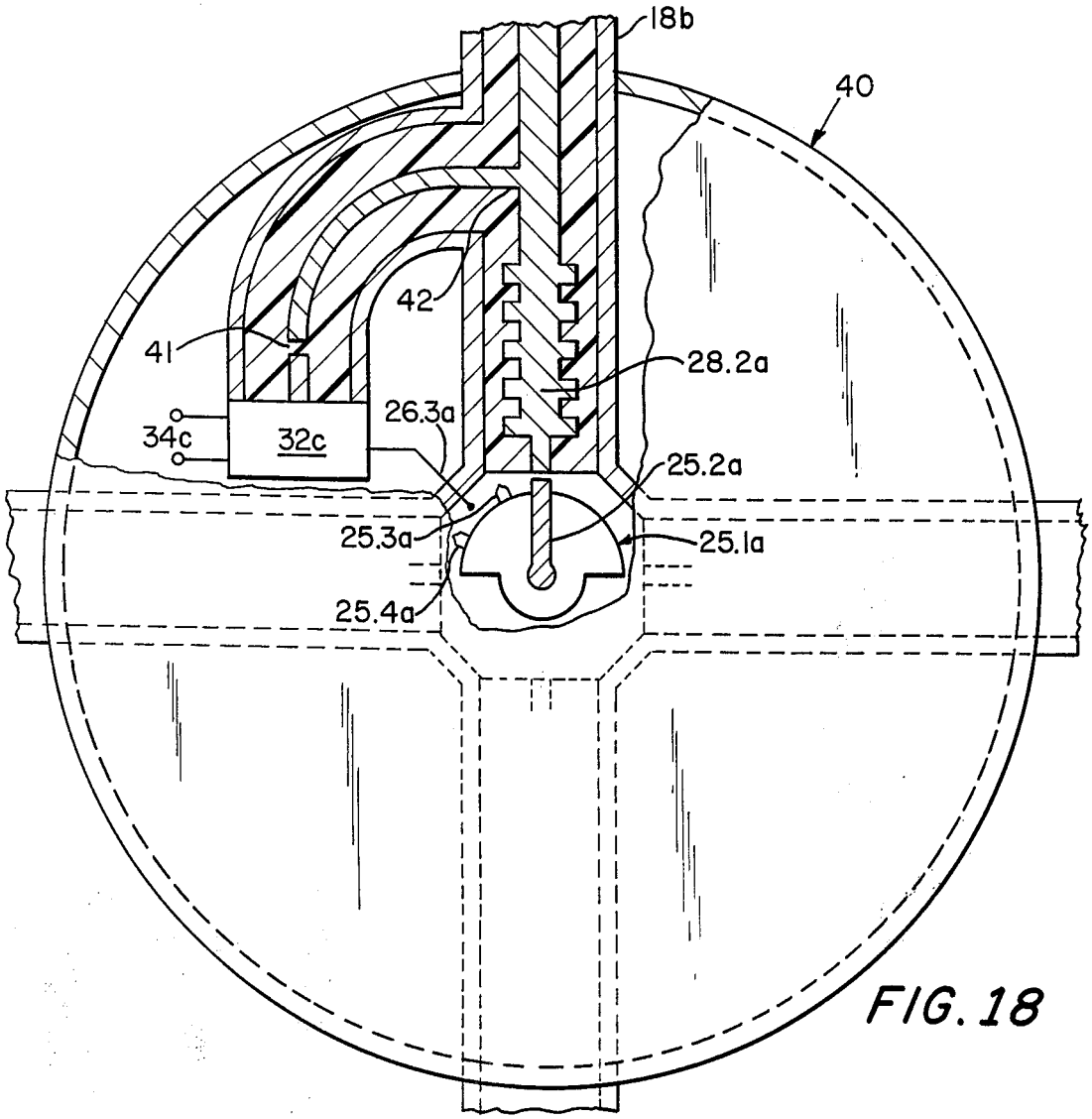
FIG. 18 is a partially broken away plan view of a solid state rf energy control and rf energy distribution unit utilized in the invention.

Another configuration that utilizes the small size of the MSD is shown in FIG. 18, which again shows a device for use with a four cylinder engine. The cylindrical container 40 is a modified form of distributor, and in addition to its usual function, it operates as a source and control of the microwave energy. The container 40 is divided into four quadrants, each one containing an MSD 32*c* which is connected to its respective spark plug cable 18*b* as shown. The MSD is shown to be probe coupled via a DC block 41; it may be also loop coupled to coaxial cable 18*b*. The rotor 25.1*a* performs the same function as already described with reference to FIG. 11; RF filter 28.2*a* is similar to that previously described and shown in FIG. 12. The MSD 32*c* obtains its timing information via switch 26.3*a* and the rotor 25.1*a*, all of which operate in the same manner as the rotor depicted in FIG. 9. MSD 32*c* obtains its power from the battery/alternator systems 15, 16 of FIG. 8 via wires 34*c*.

Besides the MSD, a magnetron RF source can be operated in a way that takes advantage of its size and cylindrical shape. Like the distributor, the magnetron is cylindrical in shape and has rotational symmetry, and can be both mechanically and electrically linked to the distributor and rotor shaft.

Figure 19:
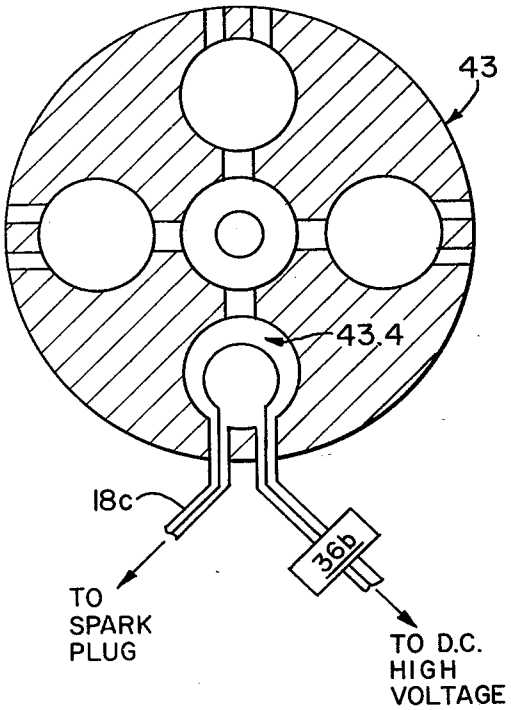
FIG. 19 is a schematic diagram of a magnetron rf generating unit used in the invention and having a coaxial cable directly coupled to the magnetron cavity.

FIG. 19 depicts a method of directly coupling the high voltage cable 18*c* to a magnetron cavity 43.4 of a magnetron 43. This allows for very efficient coupling of the microwave energy to the cable 18*c* as well as eliminating the need for a DC block which is usually included to protect the RF source (43 in this case). Such a coupling scheme can be used whenever megnetrons are used as the microwave source. An RF filter 36*b* is included to prevent the RF energy from reaching the distributor and the environment. Cable 18*c* carries both the DC and RF electrical energy to a spark plug (not shown) and plug tip which may be among any of those depicted in FIGS. 1–7.

Figure 20:
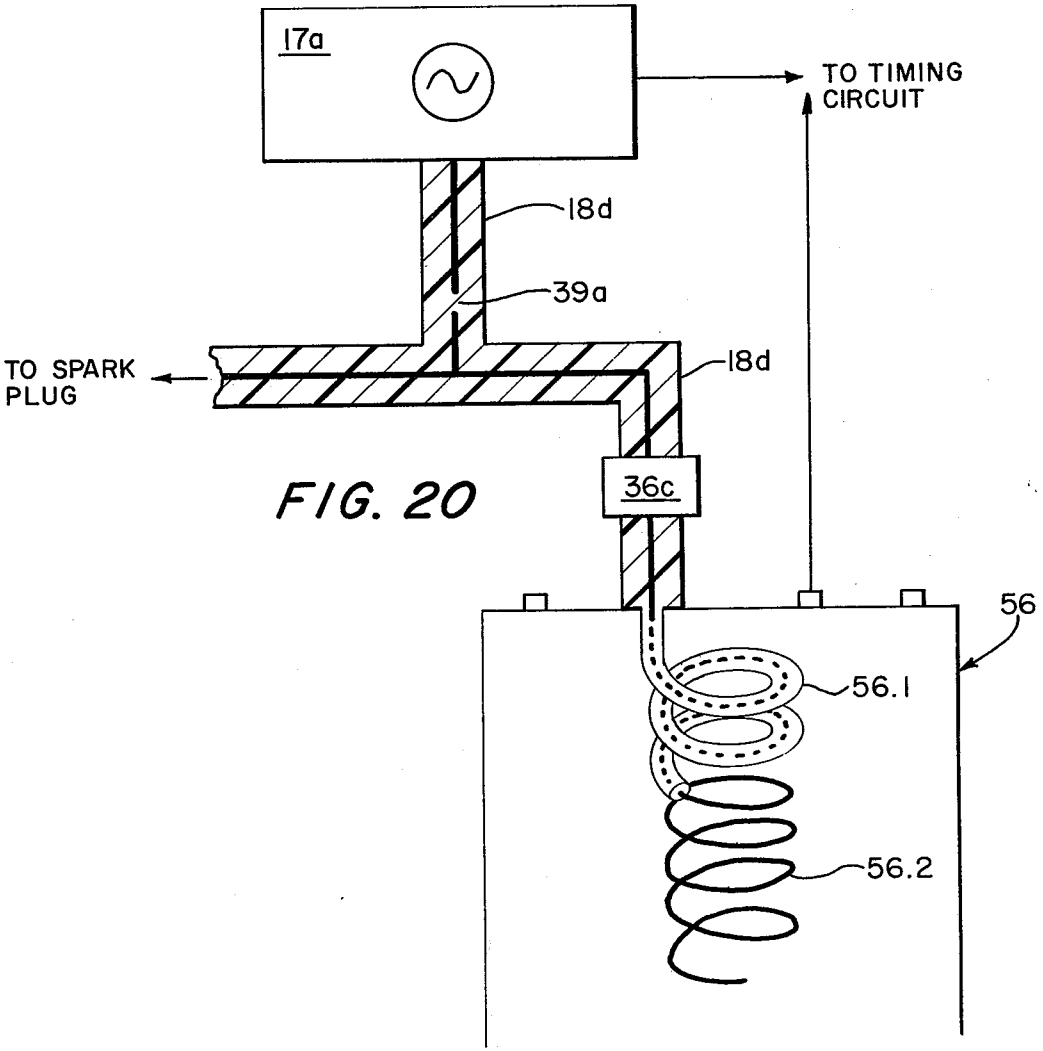
FIG. 20 is a schematic drawing of yet a further embodiment of the invention which dispenses with the need for the distributor.

As already stated, the microwave source (and coil) can obtain its timing information from any part that is mechanically linked to, and synchronous with, the crankshaft (not shown), such as the camshaft, harmonic balancer, and so on. A method that uses this principle and dispenses with the distributor is shown in FIG. 20. In this configuration, each cylinder possesses its own special design coil 56, although by including high voltage DC-RF switches such as switches 24 shown in FIGS. 8 and 10, the number of coils can be reduced. Each coil secondary winding 56.1/56.2 is connected directly to its spark plug (not shown) (or plugs if a switch is utilized) and spark plug tip such as those of FIGS. 1–7, and the microwave source 17a connects to the coil-plug transmission line 18*d*. A DC block 39*a* is required unless, of course, cable 18*d* is directly coupled to the oscillator 17*a* by means of an arrangement depicted in FIG. 19. Because the coil itself will present a large inductive reactance $X_L$ at microwave frequencies (in the section 56.2 where the outer shield of the transmission line has been removed) an RF filter may not be needed, although one is shown (36*c*). Both the coil and the RF source are connected to the timing device (not shown).

The switching and timing circuits associated with the RF source can be eliminated by connecting the RF source to all the spark plugs through a voltage divider and by designing the system to produce minimum power transfer to the non-firing cylinders. This can be done by operating the RF source continuously and by choosing the operating frequency, power level and coupling scheme in such a way that the RF source sees an almost entirely reactive load except in that cylinder that has been fired by the DC spark. That cylinder will present a large resistive load (as it contains the combusting plasma mixture) and RF power will be coupled to further enhance and to speed up the combustion process. Such an arrangement will be especially useful for engines with many cylinders, such as V8's and V12's, or other multi-spark plug engines such as the Rotary V engine.

Finally, it should be noted that microwave sources with waveguide outputs need to be coupled to a coaxial line and will require waveguide-coaxial adapters, and that these adapters will automatically provide the necessary DC isolation of the microwave source.

While various preferred embodiments have been illustrated in the accompanying drawings and described in detail herein, other embodiments are within the scope of the invention and the following claims.

I claim:

1. A system for use with an internal combustion engine having a combustion chamber, means for producing a combustible mixture therein, and means for igniting said mixture, the system comprising means for generating electromagnetic energy at an operating frequency, $f_o$, of the order of the plasma frequency, $f_{ps}$, of a species, $s$, of charged particles of said mixture where $$f_{ps} \equiv \frac{1}{2\pi} \sqrt{\frac{n_s e^2}{m_s \epsilon_o}},$$

and where $n_s$ is the species number density of the mixture, $m_s$ is the species mass, $e$ is the charge of an electron, and $\epsilon o$ is the dielectric constant of free space, and for conducting said energy to said chamber for at least about a millisecond following ignition of said mixture to couple said energy to charged particles of said species in said mixture during combustion thereof.

2. The system of claim 1 wherein said species, $s$, consists of electrons.

3. The system of claim 1 wherein said energy is also conducted to said chamber prior to said combustion.

4. The system of claim 1 wherein said energy source generates continuous wave (cw) energy which is conducted to said chamber substantially without interruption.

5. The system of claim 1 for use with an engine in which said igniting means comprise a source of substantially DC voltage connected to a spark plug having a pair of conductors, said means for conducting comprising means to couple said energy to said spark plug conductors.

6. The system of claim 5 wherein said spark plug conductors project into said combustion chamber, projecting portions thereof forming a generally smoothly curved loop having a gap therein.

7. The system of claim 5 wherein said spark plug conductors comprise substantially co-axial inner and outer conductors, said outer conductor terminating in an inwardly facing ring-shaped edge disposed generally adjacent a wall of said combustion chamber, said inner conductor projecting beyond said ring-shaped edge, whereby the gap between said edge and said inner conductor forms a spark gap for said DC voltage and the projecting portion of said inner conductor forms an antenna for coupling said energy to said combustible mixture.

8. The system of claim 1 wherein said operating frequency $f_o$, is a weighted average of the plasma frequency of said species in the initial flame front of said combusting mixture and the plasma frequency of said species in the fully developed flame front of said combusting mixture.

9. The system of claim 1 wherein said operating frequency, $f_o$, is a weighted average of the plasma frequency of electrons in the flame front of said combusting mixture and the electron-neutral collision frequency in the flame front of said combusting mixture.

10. A system for use with an internal combustion engine having a combustion chamber and means for producing a combustible mixture therein, the system comprising an energy source means for generating rf electromagnetic energy, where rf energy is energy having a frequency in the range of about $10^8$Hz to about $10^{12}$Hz, and for generating high voltage breakdown fields, and means for conducting said rf energy and said high voltage breakdown fields to said chamber to precondition said mixture for combustion, ignite said mixture, and enhance combustion reactions.

11. The system of claim 10 wherein said rf energy frequency is of the order of the plasma frequency, $f_{ps}$, of a species, $s$, of charged particles of said mixture, where $$f_{ps} \equiv \frac{1}{2\pi} \sqrt{\frac{n_s e^2}{m_s \epsilon_o}},$$

and where $n_s$ is the species number density of the mixture, $m_s$ is the species mass, $e$ is the charge of an electron, and $\epsilon o$ is the dielectric constant of free space.

12. In an internal combustion engine having a combustion chamber and means for producing a combustible mixture therein, the improvement comprising an energy source for generating rf electromagnetic energy, where rf energy is energy having a frequency in the range of about $10^8$Hz to about $10^{12}$Hz, means for generating a substantially DC voltage, and means for conducting said rf energy and said DC voltage to said chamber to precondition said mixture for combustion, ignite said mixture, and enhance combustion reactions.

13. An apparatus for attachment to the combustion chamber of an internal combustion engine for enhancing combustion of an air-fuel mixture in said chamber said apparatus comprising:

an rf source generating energy at an operating frequency of the order of the plasma frequency, $f_{ps}$, of a species, $s$, of charged particles in the plasma of the combusting mixture, where $$f_{ps} \equiv \frac{1}{2\pi} \sqrt{\frac{n_s e^2}{m_s \epsilon_o}}$$

and where $n_s$ is the species number density of the mixture, $m_s$ is the species mass, $e$ is the charge of an electron, and $\epsilon o$ is the dielectric constant of free space;

conductive means defining a spark gap across which substantially DC voltage is applied to ignite said air-fuel mixture in said chamber, said conducting means including means for coupling rf energy from said rf source to the combusting air-fuel plasma mixture for at least about a millisecond following ignition of said mixture.

14. The apparatus of claim 13 including a pre-ignition chamber into which said spark gap and said means for coupling project, said pre-ignition chamber communicating with said combustion chamber.

15. The apparatus of claim 14 including fuel injection means for injecting fuel into said pre-ignition chamber.

16. The apparatus of claim 13 wherein conductive means comprises two parts, a first part forming said spark gap as the termination of a spark plug, and a second part forming said means for coupling rf energy.

17. An apparatus for use with an internal combustion engine having n combustion chambers for the combustion of an air-fuel mixture where $n$ is an integer greater than zero, said apparatus comprising a plurality of spark splugs, one communicating with each combustion chamber for igniting said air-fuel mixture in each chamber, a source of substantially DC voltage, rf generating means for generating electromagnetic energy having a frequency in the range of from about $10^6$Hz to about $10^{12}$Hz, rf coupling means electrically connected to said rf generating means for coupling said rf energy to the combusting air-fuel plasma mixture in each of said combustion chambers, and distributor means coupled to said voltage source, said rf source, said spark plugs, and said rf coupling means for controllably distributing said DC voltage and said rf energy to said spark plugs and said rf coupling means respectively, in a predetermined timed sequence.

18. The apparatus of claim 17 wherein said distributor means comprise a DC distributor with n additional electrical conductors located for sequential communication with the distributor rotor, a control unit connected to receive timing signals as inputs from each of said additional conductors, and means to distribute the rf energy to the appropriate portion of the rf coupling means for transmission to the appropriate combustion chamber dependent upon the inputs received from said additional conductors.

19. The apparatus of claim 17 wherein said distributor means comprise a coaxial transmission line E1 section having inlet and outlet ports and being rotatable about the axis of the E1 segment including said inlet port and connected to receive both said DC voltage and said rf energy from connections disposed along said axis of rotation and to distribute sequentially to conductor means disposed around the path of rotation of said outlet port said DC voltage and rf energy, said apparatus further including means to rotationally drive said E1 section in timed relation with the operation of said internal combustion engine.

20. The apparatus of claim 19 wherein said means to rotationally drive said E1 section include means to vary the rotation rate to provide a slower rotation of said E1 section when said outlet port is substantially adjacent one of said conductor means disposed around said path of said outlet port, whereby transmission of said voltage and said rf energy from said E1 section to said conductor means is enhanced.

21. An apparatus for generating rf energy and distributing said rf energy and independently supplied high DC voltage to the $n$ combustion chambers of an internal combustion engine, where n is an integer greater than zero, said apparatus comprising a housing internally segmented into n compartments, a rotor disposed in said housing and having a portion which successively sweeps through each of said compartments during the rotation thereof, said rotor being driven in timed relation with the engine operation and being electrically connected to said source of DC voltage, each said compartment containing a source of rf energy, a coaxial conductor for conducting both said DC voltage and said rf energy from said compartment to a combustion chamber of said engine, conductor means coupling said source of RF energy to said coaxial conductor, said conductor means including DC blocking means, a contact point which electrically connects said rotor with the inner conductive means of said coaxial conductor, actuating means for actuating said source of rf energy at a predetermined orientation of said rotor with respect to said compartment, and rf energy filtering means disposed in the electrically conducting path between said source of rf energy and said rotor.

22. The method of operating an internal combustion engine comprising the repeated steps of, for each combustion chamber, supplying an air-fuel mixture to the chamber, the fuel component of said mixture comprising a fuel having a permanent electric dipole moment having resonances in the rf frequency region, compressing said mixture in said chamber, coupling rf energy to said mixture at frequencies which include at least one of said resonances, igniting the compressed mixture, and exhausting the combustion products from said chamber.

23. The method of claim 22 wherein said fuel component comprises methanol.

24. The method of claim 22 wherein said coupling continues throughout all of the other recited steps.

25. The method of claim 22 where said resonances are of the order of a plasma frequency of the ignited air-fuel plasma mixture.

* * * * *

UNITED STATES PATENT AND TRADEMARK OFFICE

CERTIFICATE OF CORRECTION

PATENT NO. : 3,934,566

DATED : January 28, 1976

INVENTOR(S) : Michael A. V. Ward

It is certified that error appears in the above-identified patent and that said Letters Patent are hereby corrected as shown below:

Column 6, line 65; "$f_d c$" should read --$f_{dc}$--.

Column 7, line 60; change equation to read $$Z_{in} \propto \frac{1}{j} \frac{1}{1 - \frac{f^2 pe}{f^2}} \frac{1}{1 - j \frac{\nu en}{2\pi f}}$$

Signed and Sealed this

Twenty-third Day of November 1976

[SEAL]

*Attest:*

RUTH C. MASON
*Attesting Officer*

C. MARSHALL DANN
*Commissioner of Patents and Trademarks*